United States Patent [19]

Scheffczyk

[11] Patent Number: 5,027,479

[45] Date of Patent: Jul. 2, 1991

[54] ADJUSTABLE CHIN STRAP FOR MOTORCYCLE HELMETS

[75] Inventor: Werner Scheffczyk, Weinbach, Fed. Rep. of Germany

[73] Assignee: Roswitha Scheffczyk, Weinbach, Fed. Rep. of Germany

[21] Appl. No.: 446,559

[22] Filed: Dec. 5, 1989

[30] Foreign Application Priority Data

Dec. 5, 1988 [DE] Fed. Rep. of Germany ..... 3840891

[51] Int. Cl.[5] ..... A44B 11/10

[52] U.S. Cl. ..... 24/196; 2/421

[58] Field of Search ..... 24/196, 191, 170, 265 AL, 24/519, 573, 615; 2/421

[56] References Cited

U.S. PATENT DOCUMENTS

| | | | |
|---|---|---|---|
| 485,482 | 11/1892 | Tileston | 24/196 |
| 909,213 | 1/1909 | Perryman | 24/191 |
| 2,538,641 | 1/1951 | Elsner | 24/170 |
| 2,977,655 | 4/1961 | Peters | 24/196 |
| 3,121,272 | 2/1964 | Matthews et al. | 24/196 |
| 3,686,715 | 8/1972 | Brodnicki | 24/68 CD |
| 4,044,400 | 8/1977 | Lewicki et al. | 2/421 |
| 4,347,630 | 9/1982 | Arai et al. | 2/421 |

FOREIGN PATENT DOCUMENTS 3629287 3/1988 Fed. Rep. of Germany .

*Primary Examiner*—Victor N. Sakran

*Attorney, Agent, or Firm*—Robert W. Becker & Associates

[57] ABSTRACT

An adjustable chin strap for motorcycle helmets, including two strap portions that are interconnected via a self-clamping, double-acting, retaining roller closure mechanism, with the closure mechanism comprising a frame having at least two retaining rollers, and on one or both short, transversely disposed parts of the frame of the closure mechanism an adjustment flap is connected so as to be pivotable about the frame part, with the span of the adjustment flap in the direction of pulling of the strap corresponding to the desired change in head size of the strap, with the adjustment flap being pivotable into the interior of the frame of the closure mechanism.

3 Claims, 1 Drawing Sheet

ADJUSTABLE CHIN STRAP FOR MOTORCYCLE HELMETS

BACKGROUND OF THE INVENTION

The present invention relates to an adjustable chin strap for motorcycle helmets, where each of the two strap portions, via a pull strap, is connected in the middle, under the chin, with a self-clamping, double-acting, retaining roller closure mechanism that comprises a frame on which at least two retaining rollers are displaceably disposed.

DE 36 29 287 C1 discloses a chin strap for motorcycle helmets where the chin strap is secured on both sides in the cheek region of the helmet. The two parts that make up the chin strap are interconnected in the middle, approximately under the chin, with a self-clamping, double-acting, retaining roller closure mechanism. The drawback of this chin strap is that in order to adapt the chin strap to various head sizes, the securement locations of the two ends of the strap on the motorcycle helmet must be altered. This is cumbersome and complicated, and in most cases is therefore not undertaken. However, chin straps can operate optimally only if the helmet is held securely on the head, and in particular even when strong forces act thereupon, for example during an accident.

It is therefore an object of the present invention to provide a simple possibility for altering the length of the chin strap when it is necessary to adapt to head sizes, and to do so after the helmet is already on the head. This adjustment possibility must be simple and must also be able to be undertaken when the motorcycle rider is wearing thick gloves.

SUMMARY OF THE INVENTION

This object is realized in that on one or both of the transversely disposed parts of the frame of the closure mechanism an adjustment flap is connected so as to be pivotable about that frame part, with the span of the adjustment flap in the pulling direction of the strap corresponding to the desired change in head size of the strap, with the adjustment flap being pivotable into the interior of the frame of the closure mechanism.

The adjustment flap can advantageously be arrested or fixed in a position of use.

The adjustment flap is expediently provided with arresting stop means that in a position of use rest against the frame of the closure mechanism.

The advantage of this construction of a chin strap with this closure mechanism is, above all, that with these relatively straightforwardly configured adjustment flaps that can also be manipulated, the chin strap can be adjusted to at least three head sizes. For example, the chin strap could be usable for the head size 62–64 if no adjustment flap is utilized. If only one adjustment flap is used, the length of the strap corresponds approximately to the head size 58–60, and if both adjustment flaps are used, the length of the strap corresponds approximately to a head size of 54–56. If adjustment flaps of different widths are used, a still greater number of head sizes can be set.

BRIEF DESCRIPTION OF THE DRAWING

One exemplary embodiment of the present invention is illustrated in the drawing, which shows.

DESCRIPTION OF PREFERRED EMBODIMENTS

Figure 1:
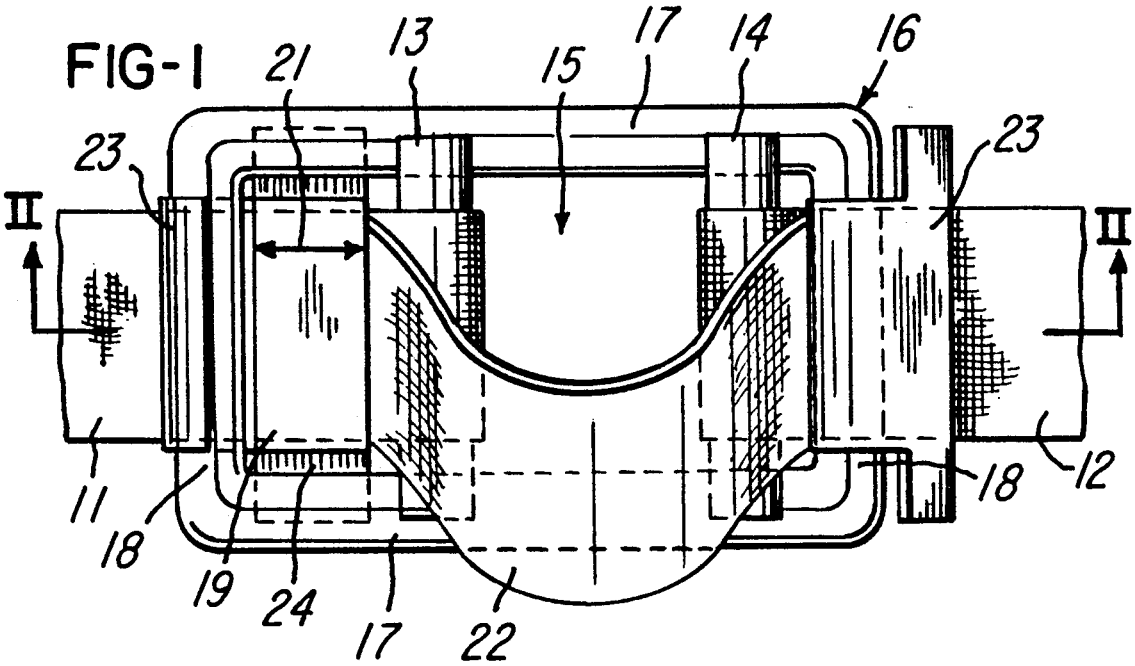
FIG. 1 a plan view of the closure mechanism in the chin strap.
Figure 2:
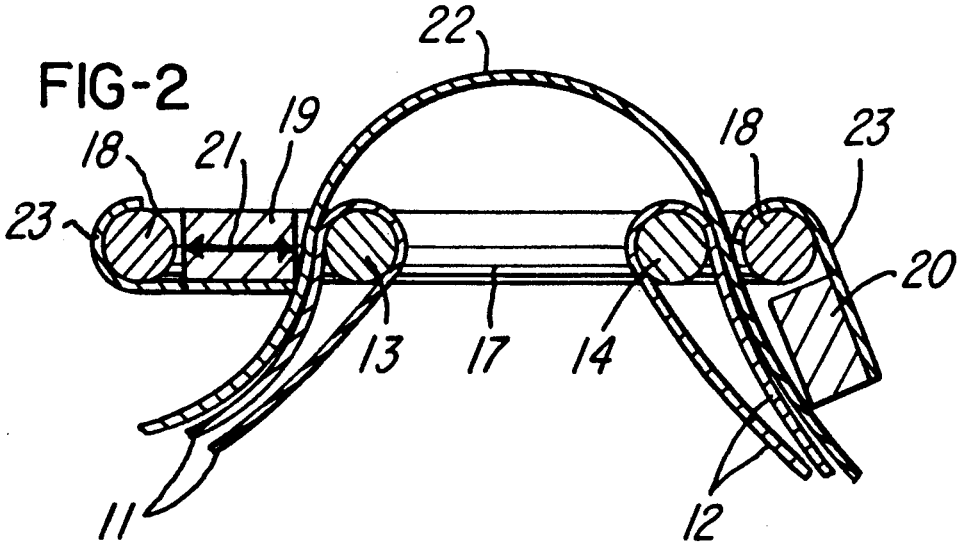
FIG. 2 a cross-sectional view taken along the line II—II in FIG. 1.

As shown in FIGS. 1 and 2, the chin strap comprises two strap portions 11 and 12, the (non-illustrated) ends of which are secured in the cheek region of the motorcycle helmet. In the middle, approximately under the chin, each of the strap portions 11 and 12 is placed in the form of a loop about a retaining roller 13 and 14 of a self-clamping, double-acting, retaining roller closure mechanism 15. This retaining roller closure mechanism 15 comprises an approximately rectangular frame 16, on the longer side portions 17 of which the two retaining rollers 13 and 14 are displaceably mounted. By pulling on the chin strap portions 11 and 12, the retaining rollers 13 and 14 shift outwardly until the strap portions 11 and 12 are securely clamped between the transversely disposed short parts 18 of the frame 16 of the closure mechanism 15 and the retaining rollers 13, 14. In this condition, the closure mechanism is closed.

Pivotably mounted on the two short, transversely disposed parts 18 of the frame 16 of the closure mechanism 15 is a respective adjustment flap 19 and 20. The width of the adjustment flaps 19, 20 corresponds approximately to the inner width of the frame 16, so that the adjustment flaps, as shown at 19, can be folded or pivoted into the interior of the frame 16. The span 21 of the adjustment flap 19, 20 in the pulling direction of the strap corresponds to the desired change in head size that is to be achieved. A span 21 of 10 mm is generally sufficient in order to represent all head sizes that are most frequently encountered.

In order to open the closure mechanism 15, a pull strap 22 is provided in a known manner.

The adjustment flaps 19, 20 are secured to a fitting 23, the transverse dimension of which, at least in the vicinity of the actual flap, is greater than the inner width of the frame 16, so that the adjustment flaps 19, 20 can be folded or pivoted only into the interior of the frame 16, whereupon the fitting 23 prevents a further pivoting. This provides for a self-positioning of the adjustment flaps 19, 20 as they are pivoted in. It is also possible to provide catch or spring elements between the adjustment flaps 19, 20 and the frame 16, especially the long portions 17 of the frame, via which the adjustment flaps can be arrested. As shown in FIG. 1, the adjustment flaps 19, 20 can be provided with arresting stop means 24 that in a position of use rest against the frame 16, and in particular the long side portions 17 thereof.

To use the inventive chin strap, first an adjustment flap 19 for the head size 58–60 is pivoted in, so that the adjustment flap assumes the position in the frame 16 illustrated in the drawing. After the helmet is put on, the chin strap is then widened by pulling the pull strap 22, so that the strap can be pushed over the chin. By the tension in the strap, the two portions 11 and 12 are securely clamped in the retaining roller closure mechanism 15, so that the length of the strap does not change anymore, and in particular even if considerable forces act upon the helmet, for example during an accident.

If the helmet is to be used for a different head size, depending upon the head size either one or even none of the adjustment flaps are pivoted in.

To remove the helmet, the pull strap 22 is pulled to such an extent that the elastic portion contained in the two strap portions 11 and 12 is pulled at least partially out of the closure mechanism 15. As a result of this movement of the pull strap 22, the retaining roller closure mechanism 15 is opened, as a result of which the chin strap is lengthened to such an extent that the strap can be pulled off toward the front over the chin. When the pull strap 22 is released, the stretched elastic portion of the strap portions 11 and 12 again draws together, so that the chin strap again maintains its normal length. Now also the chin strap can be set to the variously desired head sizes by variously pivoting in the adjustment flaps 19, 20.

The present invention is, of course, in no way restricted to the specific disclosure of the specification and drawing, but also encompasses any modifications within the scope of the appended claims.

What I claim is:

1. In an adjustable chin strap for a motorcycle helmet, where each of the two strap portions, via a pull strap, is connected in the middle, under the chin, with a self-clamping, double-acting, retaining roller closure mechanism that comprises a frame on which at least two retaining rollers are diplaceably disposed, said frame having an essentially rectangular shape, including two short, transversely disposed parts, the improvement wherein:

an adjustment flap is mounted on at least one of said transversely disposed parts in such a way as to be pivotable about that frame part into the interior of said frame, with said adjustment flap having a span in the pulling direction of said strap that corresponds to a desired change in head size of the strap.

2. An adjustable chin strap according to claim 1, which includes means for fixing said adjustment flap in a position of use.

3. An adjustable chin strap according to claim 1, in which said adjustment flap is provided with arresting stop means that in a position of use rest against said frame.

* * * * *